US006120555A

United States Patent [19]

Scialla et al.

[11] Patent Number: 6,120,555

[45] Date of Patent: Sep. 19, 2000

[54] HYPOCHLORITE BLEACHING COMPOSITIONS

[75] Inventors: Stefano Scialla, Rome, Italy; Giuseppe Trigiante, Stanford, Calif.

[73] Assignee: The Proctor & Gamble Company, Cincinnati, Ohio

[21] Appl. No.: 09/091,809

[22] PCT Filed: Dec. 13, 1996

[86] PCT No.: PCT/US96/20182

§ 371 Date: Jun. 22, 1998

§ 102(e) Date: Jun. 22, 1998

[87] PCT Pub. No.: WO97/23681

PCT Pub. Date: Jul. 3, 1997

[51] Int. Cl.[7] ..... D06L 3/06

[52] U.S. Cl. ..... 8/108.1; 510/303; 510/379; 510/380

[58] Field of Search ..... 8/108.1; 510/303, 510/379, 380

[56] References Cited

U.S. PATENT DOCUMENTS

| | | |
|---|---|---|
| 1,514,068 | 11/1924 | Phair . |
| 2,097,517 | 11/1937 | Durgin . |
| 2,435,474 | 2/1948 | Soule . |
| 2,829,110 | 4/1958 | Robson . |
| 3,640,879 | 2/1972 | Fitzgerald, Jr. . |

*Primary Examiner*—Margaret Einsmann
*Attorney, Agent, or Firm*—Jason J. Camp; T. David Reed

[57] ABSTRACT

Liquid aqueous bleaching compositions are disclosed which comprise a pH buffering means with low sensitivity to water hardness and an alkali metal hypochlorite. A method of treating fabrics with said compositions is also disclosed.

21 Claims, No Drawings

HYPOCHLORITE BLEACHING COMPOSITIONS

TECHNICAL FIELD

The present invention relates to a liquid bleaching composition which is suitable for laundry applications including hand washing as well as washing with automatic washing machines.

BACKGROUND OF THE INVENTION

Liquid bleaching compositions are well-known in the art. Amongst the different bleaching compositions available, those relying on bleaching by hypochlorite are often preferred, mainly for performance reasons, especially at lower temperature.

However, there are some limitations to the convenience of hypochlorite bleaches. In particular, it is well-known from consumers that the drawbacks associated with the use of hypochlorite-based compositions are that said compositions may damage and/or yellow the fabrics which are being bleached.

It is therefore an object of the present invention to provide a hypochlorite-containing composition, suitable for use in laundry application, whereby the fabric whiteness is improved.

It is a further object of the present invention to provide a hypochlorite-containing composition, suitable for use in laundry application, whereby fabric safety is improved.

We have now found that the previous objects can be met by formulating an alkaline liquid composition comprising an alkali metal hypochlorite or mixtures thereof and a pH buffering means with low sensitivity to water hardness, i.e. a pH buffering means which, when used in a 1M solution at pH 10, requires more than 2.5 mM of calcium ion, in order to cause precipitation at 25° C. of the calcium salt of the alkali anion of said pH buffering means. Said composition allows to provide improved fabric whiteness and/or improved fabric safety on the fabrics treated therewith, as compared to the same composition without said pH buffering means with low sensitivity to water hardness according to the present invention. We have also found that, in the preferred embodiment of the present invention wherein the liquid hypochlorite bleach-containing compositions comprise said pH buffering means with low sensitivity to water hardness together with a precipitation agent like carbonate salt and/or silicate salt, outstanding whiteness and/or fabric safety performance are provided. Indeed, it has been found that the use of a pH buffering means with low sensitivity to water hardness together with a precipitation agent like silicate salt and/or carbonate salt in a hypochlorite bleaching composition results in a complementary effect on fabric whiteness performance and/or fabric safety performance.

An advantage of the compositions of the present invention is that they allow to provide outstanding fabric whitening action and/or fabric safety properties without compromising on the stain removal performance on different types of stains including bleachable stains (e.g. coffee), enzymatic stains (e.g. blood) and greasy stains (e.g. lipstick).

Another advantage of the compositions of the present invention is that said bleaching compositions are suitable for the bleaching of different types of fabrics including natural fabrics, (e.g., fabrics made of cotton, viscose, linen, silk and wool), synthetic fabrics such as those made of polymeric fibers of synthetic origin as well as those made of both natural and synthetic fibers. Indeed, the compositions of the present invention may be used on synthetic fibers despite a standing prejudice against using hypochlorite bleaches on synthetic fibers, as evidenced by warnings on labels of commercially available hypochlorite bleaches and clothes.

A further advantage is that the liquid compositions according to the present invention comprising a pH buffering means with low sensitivity to water hardness allow a prolonged through-the-bleach buffering action, i.e. to maintain the pH of the bleaching solution as high as possible during the whole bleaching cycle from the moment the dilution is completed, without increasing the pH of the compositions per se as compared to the same compositions but without said pH buffering means.

Compositions comprising hypochlorite and pH buffering means have been described in the art.

WO 88/05462 discloses a composition for removing stains from fabrics comprising an aqueous solution of trisodium phosphate, sodium hydroxide, sodium hypochlorite and a buffer to maintain a pH of between about 10 and 12 such a sodium carbonate, sodium bicarbonate, sodium sesquicarbonate or mixtures thereof. WO 88/05462 further discloses that it is preferred that the buffer system employed holds the pH as close to pH 10 as possible, consistent with effective stain removal to provide a product which is more gentle to skin and fabrics than a higher pH. WO 88/0562 also discloses a process of removing stains from fabrics with said compositions. However, pH buffering means having a low sensitivity to water hardness as described herein are nowhere disclosed in WO 88/05462.

EP-A-622 451 discloses compositions suitable for use in diluted form, comprising hypochlorite, sodium hydroxide, a bleach stable perfume and as a buffering system whereby the pH of the diluted composition is buffered to a constant value throughout use, carbonate and/or silicate. EP-A-622 451 also discloses a method of bleaching wherein such a composition is contacted with fabrics. No pH buffering means with low sensitivity to water hardness are disclosed.

EP-A-653 482 and EP-A-668 345 disclose hypochlorite-containing compositions comprising a source of strong alkalinity, a pH buffering means and optionally other types of ingredients such as respectively radical scavengers and polycarboxylate acids of pyridine. The pH buffering means disclosed therein are alkali metal silicate and/or carbonate, sodium borate and sodium sesquicarbonate. pH buffering means having a low sensitivity to water hardness as described herein are nowhere disclosed in said patent applications.

UK 1282 906 discloses stabilised aqueous alkali metal hypochlorite solutions comprising as a stabiliser an alkali metal heptonate or boroheptonate. "Alkali metal boroheptonate" as used in UK 1282 906 refers to a mixture of an alkali metal heptonate with either boric acid or an alkali metal metaborate and generally containing two gram moles of alkali metal heptonate per gram atom of boron in the boric acid or metaborate. However, no strong source of alkalinity nor the pH of the solutions therein are disclosed. Also no laundry application is disclosed.

BE-749728 discloses an aqueous system comprising an N-hydrogenate and a hypohalite such as hypobromite, hypochlorite or hypoiodite in equilibrium with the corresponding N-halogenated compound, and a buffering system to maintain the pH of said system in a range of 4 to 11 to stabilise it before use. The buffering system mentioned therein are generically acetates, carbonates, phosphates, polyphosphates, organophosphates, borates, polyborates, organoborates, silicates, polysilicates, organosilicates or mixtures thereof. Strong sources of alkalinity such as sodium/potassium hydroxide are also disclosed. These bleaching compositions are particularly suitable to bleach textiles. But BE 749728 fails to make a distinction between pH buffering means being sensitive to water hardness like silicates or carbonates and pH buffering means with a low sensitivity to water hardness, as the ones described in the present invention.

U.S. Pat. No. 4,000,082 discloses defoaming compositions based on lithium salts. More particularly, U.S. Pat. No. 4,000,082 discloses aqueous cleaning compositions comprising anionic surfactants, nonionic surfactants, from 5% to 50% by weight of the total composition of a highly alkaline compound selected from the group of sodium hydroxide, sodium carbonate, sodium bicarbonate, sodium metaborate and the like, and from 1% to 5% by weight of a lithium salt including lithium hypochlorite. No bleaching application is disclosed, let alone laundry bleaching application.

Actually, the benefits derivable from the use of a pH buffering means according to the present invention, which, when used in a 1M solution at pH 10, requires more than 2.5 mM of calcium ions, in order to cause precipitation at 25° C. of the calcium salt of the alkali anion of said pH buffering means, in an alkaline liquid bleaching composition comprising hypochlorite, for bleaching fabrics, i.e. improved fabric whiteness and/or fabric safety on the fabrics treated therewith, have not been acknowledged in the prior art.

SUMMARY OF THE INVENTION

The present invention encompasses a liquid bleaching composition having a pH of from 8 to 14, said composition comprising an alkali metal hypochlorite, or mixtures thereof, and a pH buffering means which, when used in a 1M solution at pH 10, requires more than 2.5 mM of calcium ions, in order to cause precipitation at 25° C. of the calcium salt of the alkali anion of said pH buffering means, with the proviso that said alkali metal hypochlorite is not lithium hypochlorite when said pH buffering means is sodium metaborate.

A method of bleaching fabrics to improve fabric whiteness and/or fabric safety which comprises the step of contacting said fabrics with a liquid bleaching composition having a pH of from 8 to 14, said composition comprising an alkali metal hypochlorite, or mixtures thereof, and a pH buffering means which, when used in a 1M solution at pH 10, requires more than 2.5 mM of calcium ions, in order to cause precipitation at 25° C. of the calcium salt of the alkali anion of said pH buffering means.

DETAILED DESCRIPTION OF THE INVENTION

The compositions of the present invention are liquid bleaching compositions. Thus, as a first essential ingredient, the compositions of the present invention comprise hypochlorite. Various forms of alkali metal hypochlorite are commercially available and, although this is not critical for the present invention, it is preferred herein to use sodium hypochlorite. Compositions according to the present invention comprise a bleaching amount of an alkali metal hypochlorite, or mixtures thereof, which typically represent from 0.1% to 20% by weight of the total composition, based on active chlorine, of said alkali metal hypochlorite. Preferred compositions herein comprise from 0.5% to 8%, based on active chlorine, of an alkali metal hypochlorite, or mixtures thereof.

As a second essential ingredient, the compositions according to the present invention comprise a pH buffering means with a low sensitivity to water hardness or mixtures thereof, i.e. a pH buffering means which, when used in a 1M solution of the buffer at pH 10, requires more than 2.5 millimoles (mM) of calcium ions, preferably more than 3.5 mM, and more preferably more than 5 mM of said calcium ions, in order to cause precipitation at 25° C. of the calcium salt of the alkali anion of said pH buffering means.

Accordingly, suitable pH buffering means to be used herein are selected by evaluating the amount of Ca ions required, when used in a 1M solution at pH 10, in order to cause precipitation at 25° C. of the calcium salt of the alkali anion of said buffering means. This amount of Ca ions requested can be measured with the test method reported hereinafter in the experimental data.

Suitable pH buffering means with a low sensitivity to water hardness preferably have their buffering pH, i.e. pKa of their conjugated acids, between 8.5 and 13, and more preferably between 9 and 11.

Examples of said pH buffering means with a low sensitivity to water hardness include alkali metal salts of metaborate and stannate and mixtures thereof. Particularly preferred herein are the alkali metal salts of metaborate such as sodium metaborate and potassium metaborate, or mixtures thereof.

The compositions according to the present invention comprise from 0.01% to 20% by weight of the total composition of said pH buffering means which, when used in a 1M solution at pH 10, requires more than 2.5 mM of calcium ions, in order to cause precipitation at 25° C. of the calcium salt of the alkali anion of said pH buffering means, preferably from 0.1% to 15%, and more preferably from 0.5% to 8%.

It has now been found that the addition of a pH buffering means which, when used in a 1M solution at pH 10, requires more than 2.5 mM of calcium ions, in order to cause precipitation at 25° C. of the calcium salt of the alkali anion of said pH buffering means, in a liquid composition containing hypochlorite allows a prolonged through-the-bleach buffering action, i.e. allows to maintain the pH of the bleaching solution as high as possible for a longer period of time from the moment the dilution is completed, as compared to the buffering action obtained with the same composition without said pH buffering means or with the same composition but with another ingredient acting as a pH buffering means such as carbonate salts and/or silicate salts instead of said pH buffering means.

It has been found that the buffering action of said pH buffering means allows to reduce the conversion of hypochlorite into hypochlorous acid, one of the species which are most responsible for the fabric damage and/or fabric whiteness, thereby providing improved fabric safety and/or fabric whiteness.

By "improved fabric whiteness" it is meant herein that the whiteness on fabric achieved by using the hypochlorite compositions of the present invention is improved compared to the whiteness obtained by using the same hypochlorite compositions without said pH buffering means or by using the same compositions but with another ingredient acting as a pH buffering means such as carbonate salts and/or silicate salts instead of said pH buffering means according to the present invention.

By "improved fabric safety" it is meant herein that the damage caused on fabric by using the hypochlorite compositions of the present invention is reduced compared to the damage caused by using the same hypochlorite compositions without said pH buffering means or by using the same compositions but with another ingredient acting as a pH buffering means such as carbonate salts and/or silicate salts instead of said pH buffering means according to the present invention.

[aldehydic group] from fabrics+Cu++→Cu2O (cuprous oxide)

Then Fe+++ ions is added so as to form ferrous sulphate in an amount exactly equivalent to the cuprous oxide present.

Fe2(SO4)3+Cu2O+H2SO4→2FeSO4+H2SO4+2CuSO4

Finally, the ferrous sulphate is measured by titration with 0.1N potassium permanganate that oxide Fe++ (ferrous) ions to Fe+++ (ferric) ions. Fabric safety may also be evaluated by the tensile strength loss test. This method consists in measuring the tensile strength of a given fabric by pulling said fabrics until they break. The force, expressed in Kg, necessary to break said fabrics is the "ultimate tensile stress" and may be measured with "the stress-strain Instron tensilometer". The lower the force needed to break said fabrics, the less fabric damage is caused on the fabrics.

An advantage of the present invention is that the buffering of the hypochlorite compositions of the present invention reduces harshness to hands.

As a third essential feature, the compositions according to the present invention have a pH as is of from 8 to 14, preferably of from 9 to 13.5, and more preferably of from 9.5 to 13.5. It is in this alkaline range that the optimum stability and performance of the hypochlorite is obtained.

Accordingly, the compositions of the present invention comprise a strong source of alkalinity. Preferred compositions herein comprise up to 10% by weight of the total composition of said strong source of alkalinity, or mixtures thereof, preferably of from 0.04% to 5% and more preferably of from 0.1% to 2%. Examples of strong sources of alkalinity are alkali metal hydroxides, such as potassium and/or sodium hydroxide, or alkali metal oxides such as sodium and/or potassium oxide.

The compositions of the present invention are aqueous. Thus, they comprise is water preferably in an amount of from 60% to 98% by weight of the total aqueous liquid bleaching composition, more preferably of from 80% to 97% and most preferably of from 85% to 97%.

The composition according to the present invention may further comprise as an optional but preferred ingredient a precipitation agent. Particularly useful to be used herein are alkali metal salts of carbonates, polycarbonates, sesquicarbonates, silicates, polysilicates or mixtures thereof. The preferred alkali metal salts to be used herein are sodium and potassium. Particularly preferred precipitation agents are alkali metal salts of silicate and/or carbonate. The preferred alkali metal salts of silicate and carbonates are sodium silicate and sodium carbonate, both of which are commercially available, or mixtures thereof.

The compositions of the present invention comprise up to 5% by weight of the total composition of a precipitation agent, preferably from 0.01% to 4% and more preferably from 0.02% to 3%

We speculate that said precipitation agents such as sodium carbonate and/or sodium silicate, when added in an alkaline liquid composition comprising hypochlorite and a pH buffering means which, when used in a 1M solution at pH 10, requires more than 2.5 mM of calcium ions, in order to cause precipitation at 25° C. of the calcium salt of the alkali anion of said pH buffering means, have a further action on top of the one of said pH buffering means allowing thereby to further improve the fabric whiteness and/or the fabric safety of fabrics treated with said composition. Indeed, said precipitation agent allows to reduce or even eliminate the impurities both in said compositions as is and especially in the bleaching environment. Said impurities include calcium, magnesium as well as heavy metal ions such as Cu, Fe, Ni, Co and the like, which have been found to adversely affect both fabric whiteness and fabric safety.

Indeed, we believe that in the bleaching/washing environment the metal ions catalyse the attack of hypochlorite on fabrics with the generation of yellow oxidised species. It is further speculated that said metal ions are adsorbed per se on oxidised fabrics as coloured species and catalyse the degradation of the brighteners adsorbed on fabrics. Also said metal ions stabilise colored pigments of enzymatic stains such as blood and grass. Also metal ions catalyse the depolymerisation of cotton fibres which leads to reduced tensile strength of the fabrics, thereby reducing fabrics resistance.

The precipitation agents according to the present invention may also act as pH buffering means, completing thereby the pH buffering action of the pH buffering means according to the present invention.

The compositions according to the present invention may further comprise other optional ingredients such as bleach-stable surfactants, organic or inorganic alkalis, pigments, dyes, optical brighteners, solvents, chelating agents, radical scavengers and the like.

The compositions according to the present invention are preferably used in diluted form in laundry application. The expression "use in diluted form" herein includes dilution by the user, which occurs for instance in hand laundry applications, as well as dilution by other means, such as in a washing machine. Preferred dilution levels are of from 0.1% to 20% for hand laundry application and 0.1% to 10% in a washing machine.

The present invention further encompasses a method of bleaching fabrics which comprises the step of contacting said fabrics with a liquid bleaching composition having a pH of from 8 to 14, said composition comprising an alkali metal hypochlorite, or mixtures thereof, and a pH buffering means which, when used in a 1M solution at pH 10, requires more than 2.5 mM of calcium ions, in order to cause precipitation at 25° C. of the calcium salt of the alkali anion of said pH buffering means. In a preferred embodiment, the compositions used in said method of bleaching fabrics may further comprise a precipitation agent as defined herein before. Said method according to the present invention improves the fabric whiteness and/or the fabric safety.

More specifically, the method of bleaching fabrics according to the present invention comprises the steps of first contacting said fabrics with a liquid bleaching composition having a pH of from 8 to 14, said composition comprising an alkali metal hypochlorite, or mixtures thereof and a pH buffering means which, when used in a 1M solution, at pH 10, requires more than 2.5 mM of calcium ions, in order to cause precipitation at 25° C. of the calcium salt of the alkali anion of said pH buffering means, then allowing said fabrics to remain in contact with said composition, for a period of time sufficient to bleach said fabrics, typically 1 to 60 minutes, preferably 5 to 30 minutes, then rinsing said fabrics in water to remove said composition. If said fabrics are to be washed, i.e. with a conventional composition comprising at least one surface active agent, said washing may be conducted together with the bleaching of said fabrics by contacting said fabrics at the same time with a bleaching composition according to the present invention and said detergent composition, or said washing may be conducted before or after that said fabrics have been bleached. Accordingly, said method according to the present invention allows to bleach fabrics and optionally to wash fabrics with a detergent composition comprising at least one surface active agent before the step of contacting said fabrics with said bleaching composition and/or in the step where said fabrics are contacted with said bleaching composition and/or after the rinsing step when said bleaching composition has been removed from said fabrics.

It is preferred to perform the bleaching method herein before said fabrics are washed. Indeed, it has been observed that bleaching said fabrics with the compositions according to the present invention prior to washing them with a detergent composition provides superior whiteness and stain removal with less energy and detergent than if said fabrics are washed first, then bleached.

The alkaline liquid compositions according to the present invention comprising an alkali metal hypochlorite, a pH buffering means which, when used in a 1M solution at pH 10, requires more than 2.5 mM of calcium ions, in order to cause precipitation at 25° C. of the calcium salt of the alkali anion of said pH buffering means, a strong source of alkalinity to obtain the desired pH, and optionally a precipitation agent may be manufactured by a process comprising the steps of:

mixing said alkali metal hypochlorite, said strong source of alkalinity and water, adding said pH buffering means and optionally said precipitation agent, and thereafter separating the precipitates formed from said composition.

By "separating the precipitates formed" it is meant herein that any means known to remove a solid phase from a liquid phase may be used. Accordingly the precipitates formed may be removed from the compositions of the present invention by settling and/or filtration and/or centrifugation.

EXPERIMENTAL DATA

Sensitivity to water hardness was defined by the following test method:

1M solutions of the buffers to study were prepared, 100 g of each solution were weighted, the pH was trimmed down to 10, and said solutions were filtered to eliminate any precipitates that may have formed. Then to each of said 1M solution of buffering means a stock solution (0.05M) of calcium chloride was added by 0.5 ml steps. After 20 minutes of stirring, turbidity was measured by optical spectroscopy at 360 nm versus a reference made of the neat solution. The experiment was stopped on formation of precipitates and the amount of calcium added was recorded.

The results are the following:

| Buffer means | [Ca] mM | ml Ca added |
|---|---|---|
| Carbonate | 0.5 | 1.0 |
| Silicate | 0.015 | 0.3 |
| Stannate | 3.7 | 7.3 |
| Borate | 0.025 | 0.5 |
| Metaborate | more than 7.5 | more than 15 |

The following compositions which further illustrate the present invention were made by mixing the listed ingredients in the listed proportions:

| Compositions (weight %) | 1 | 2 | 3 | 4 | 5 | 6 | 7 |
|---|---|---|---|---|---|---|---|
| Sodium hypochlorite | 5.0 | 5.0 | 5.0 | 2.5 | 2.5 | 5.0 | 5.0 |
| Sodium hydroxide | 0.7 | 0.7 | 1.4 | 0.7 | 1.4 | 0.7 | 1.4 |
| Sodium carbonate | 1.0 | — | 1.2 | 1.0 | 1.2 | 1.2 | 1.2 |
| Sodium silicate | — | — | — | — | — | 0.2 | — |
| Sodium metaborate | 1.0 | 1.0 | 1.0 | 0.75 | 1.0 | 0.75 | 0.5 |
| Water | ---------- 100% ---------- | | | | | | |

All the compositions above provided improved fabric safety and/or improved whiteness to fabrics when used to treat fabrics without compromising on stains removal performance on a wide variety of stains like bleachable stains, enzymatic stains and greasy stains.

What is claimed is:

1. A liquid bleaching composition having a pH of from 8 to 14, said composition comprising an alkali metal hypochlorite or mixtures of two or more alkali metal hypochlorites, and a pH buffering means, wherein said pH buffering means, when used in a 1M solution at pH 10, requires more than 2.5 mM of calcium ions, in order to cause precipitation at 25° C. of the calcium salt of the alkali anion of said pH buffering means; wherein said pH buffering means is selected from the group consisting of alkali metal salts of metaborate, alkali metal salts of stannate, and mixtures thereof; and wherein said alkali metal hypochlorite is not lithium hypochlorite when said pH buffering means is sodium metaborate.

2. A composition according to claim 1 wherein said composition comprises from about 0.1% to about 20% by weight of the total composition, based on active chlorine, of hypochlorite.

3. A composition according to claim 2 wherein said composition comprises from about 0.5% to about 8% by weight of the total composition, based on active chlorine, of hypochlorite.

4. A composition according to claim 1 wherein said pH buffering means requires, when used in a 1M solution at pH 10, more than 3.5 mM of calcium ions, in order to cause precipitation at 25° C. of the calcium salt of the alkali anion of said pH buffering means, and wherein said pH buffering means has a pKa of its conjugated acid, between about 8.5 and about 13.

5. A composition according to claim 1 wherein the pH of said composition is from about 9 to about 13.5.

6. A composition according to claim 1 wherein said composition comprises from about 0.01% to about 20% by weight of the total composition of said pH buffering means.

7. A composition according to claim 6 wherein said composition comprises from about 0.1% to about 15% by weight of the total composition of said pH buffering means.

8. A composition according to claim 1 wherein said composition comprises up to about 5% by weight of the total composition of a precipitation agent, and wherein said precipitation agent is an alkali metal salt of carbonates, polycarbonates, sesquicarbonates, silicates, polysilicates, or mixtures thereof.

9. A composition according to claim 1 wherein said pH buffering means is sodium metaborate, potassium metaborate or mixtures thereof.

10. A composition according to claim 8, wherein said precipitation agent is sodium carbonate and/or sodium silicate.

11. A method of bleaching fabrics to improve fabric whiteness and/or fabric safety which comprises the step of contacting said fabrics with a liquid bleaching composition having a pH of from about 9 to about 14, said composition comprising an alkali metal hypochlorite or mixtures of two or more alkali metal hypochlorites, and a pH buffering means, wherein said pH buffering means, when used in a 1M solution at pH 10, requires more than 2.5 mM of calcium ions, in order to cause precipitation at 25° C. of the calcium salt of the alkali anion of said pH buffering means; and wherein said pH buffering means is selected from the group consisting of alkali metal salts of metaborate, alkali metal salts of stannate, and mixtures thereof.

12. A method of bleaching fabrics according to claim 11 which, after the step of contacting said fabrics with said bleaching composition, further comprises the steps of:

allowing said fabrics to remain in contact with said bleaching composition for a period of time sufficient to bleach said fabrics, then rinsing said fabrics in water to remove said bleaching composition.

13. A method according to claim 12 wherein said fabrics are washed with a detergent composition comprising at least one surface active agent before the step of contacting said fabrics with said bleaching composition and/or in the step where said fabrics are contacted with said bleaching composition and/or after the rinsing step when said bleaching composition has been removed.

14. A method according to claim 13 wherein said bleaching composition is contacted to said fabrics in its diluted form.

15. A method according to claim 13 wherein said bleaching composition comprises from about 0.1% to about 20% by weight of the total composition, based on active chlorine, of hypochlorite.

16. A method according to claim 15 wherein said pH buffering means requires, when used in a 1M solution at pH 10, more than 3.5 mM of calcium ions, in order to cause precipitation at 25° C. of the calcium salt of the alkali anion of said pH buffering means, and wherein said pH buffering means has a pKa of its conjugated acid, between about 8.5 and about 13.

17. A method according to claim 13 wherein said bleaching composition comprises from about 0.01% to about 20% by weight of the total composition of said pH buffering means.

18. A method according to claim 13 wherein said bleaching composition comprises up to about 5% by weight of the total composition of a precipitation agent, and wherein said precipitation agent is an alkali metal salt of carbonates, polycarbonates, sesquicarbonates, silicates, polysilicates, or mixtures thereof.

19. A method according to claim 13 wherein the pH of said bleaching composition is from about 9 to about 13.5.

20. A method according to claim 1 wherein said pH buffering means is sodium metaborate, potassium metaborate or mixtures thereof.

21. A method according to claim 18 wherein said precipitation agent is sodium carbonate and/or sodium silicate.

* * * * *